US005339882A

United States Patent [19]

Judkins

[11] Patent Number: 5,339,882

[45] Date of Patent: Aug. 23, 1994

[54] VENETIAN-TYPE WINDOW COVERING

[75] Inventor: Ren Judkins, County of Allegheny, Pa.

[73] Assignee: Verosol USA Inc., Pittsburgh, Pa.

[21] Appl. No.: 952,645

[22] Filed: Sep. 28, 1992

Related U.S. Application Data

[63] Continuation-in-part of Ser. No. 624,312, Dec. 4, 1990, Pat. No. 5,176,192, which is a continuation-in-part of Ser. No. 340,301, Apr. 19, 1989, Pat. No. 4,974,656, which is a continuation-in-part of Ser. No. 30,167, Mar. 25, 1987, abandoned.

[51] Int. Cl.[5] ..... A47H 5/00

[52] U.S. Cl. ..... 160/84.1 D; 160/121.1

[58] Field of Search ..... 160/84.1 C, 370.2, 121.1, 160/84.1 D, 120, 122, 89

[56] References Cited

U.S. PATENT DOCUMENTS

| | | | |
|---|---|---|---|
| Re. 30,254 | 4/1980 | Rasmussen . | |
| 1,937,342 | 11/1933 | Higbie . | |
| 2,865,446 | 12/1958 | Cole | 160/121.1 X |
| 2,914,122 | 11/1959 | Pinto | 160/166.1 X |
| 3,384,519 | 5/1968 | Froget | 156/65 |
| 4,019,554 | 4/1977 | Rasmussen | 160/84.1 |
| 4,069,857 | 1/1978 | Brookshire | 160/84.1 |
| 4,625,786 | 12/1986 | Carter et al. | 160/84.1 |
| 4,951,729 | 8/1990 | Chi Yu . | |
| 4,984,617 | 1/1991 | Corey | 160/84.1 |
| 5,104,469 | 4/1992 | Colson | 160/84.1 |

FOREIGN PATENT DOCUMENTS

| | | |
|---|---|---|
| 249985 | 5/1963 | Australia . |
| 3525515 | 1/9897 | Fed. Rep. of Germany . |

*Primary Examiner*—David M. Purol
*Attorney, Agent, or Firm*—Buchanan Ingersoll

[57] ABSTRACT

A window covering structure has a sheet of first material spaced apart from a sheet of second material. A series of slats are connected between the first material and the second material. A first and second connecting portion connects the slats to the first and second material respectively. When the window covering is in an open position relative to one another, the slats are substantially perpendicular to the first and second materials. When the window covering is in a closed position, the slat intermediate portions are generally aligned to be substantially parallel to the first and second materials.

11 Claims, 9 Drawing Sheets

FIG. 1
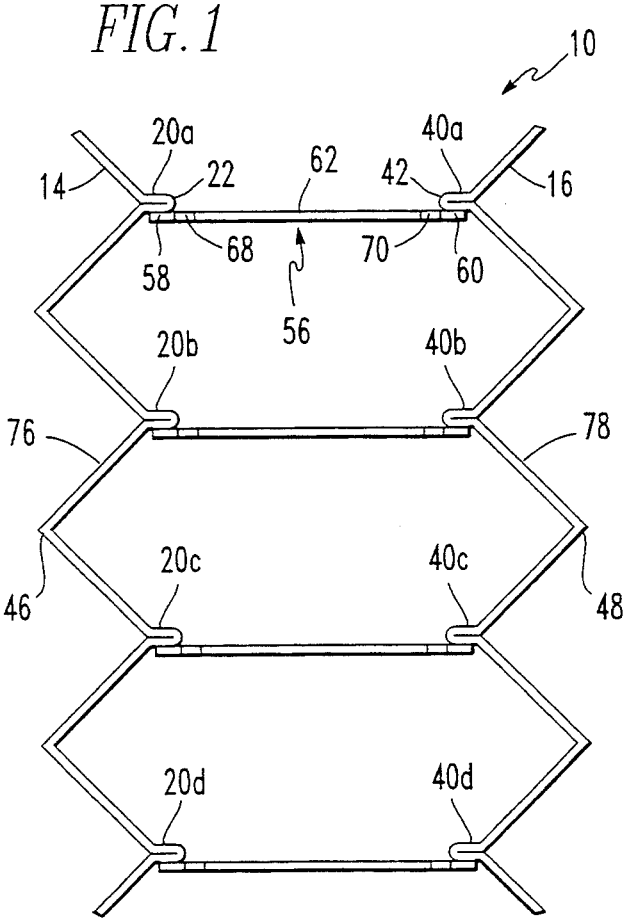
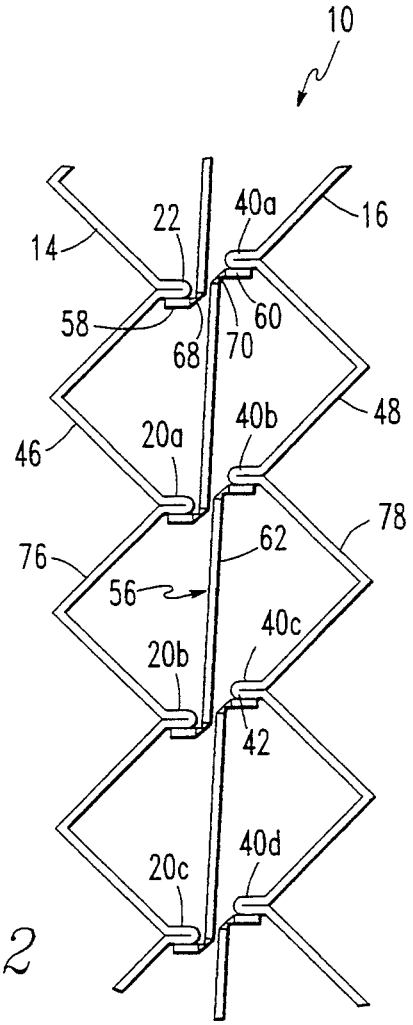
FIG. 2

FIG. 4
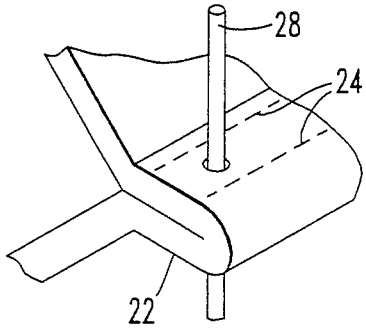
FIG. 5
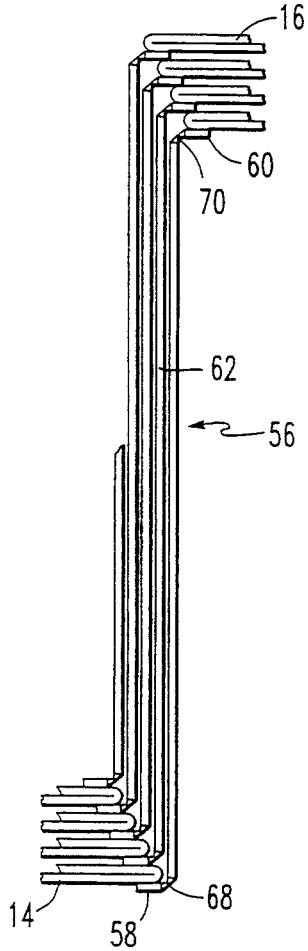
FIG. 4A
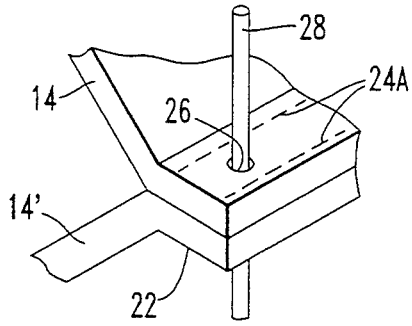
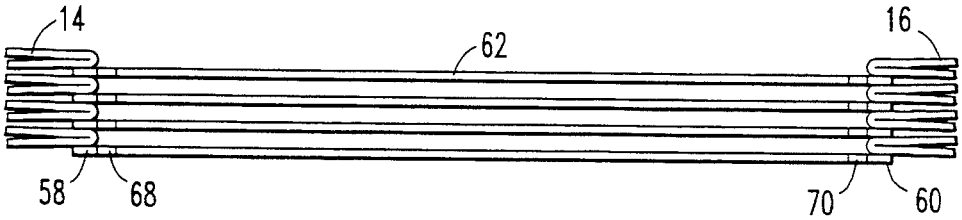
FIG. 5A

FIG. 6
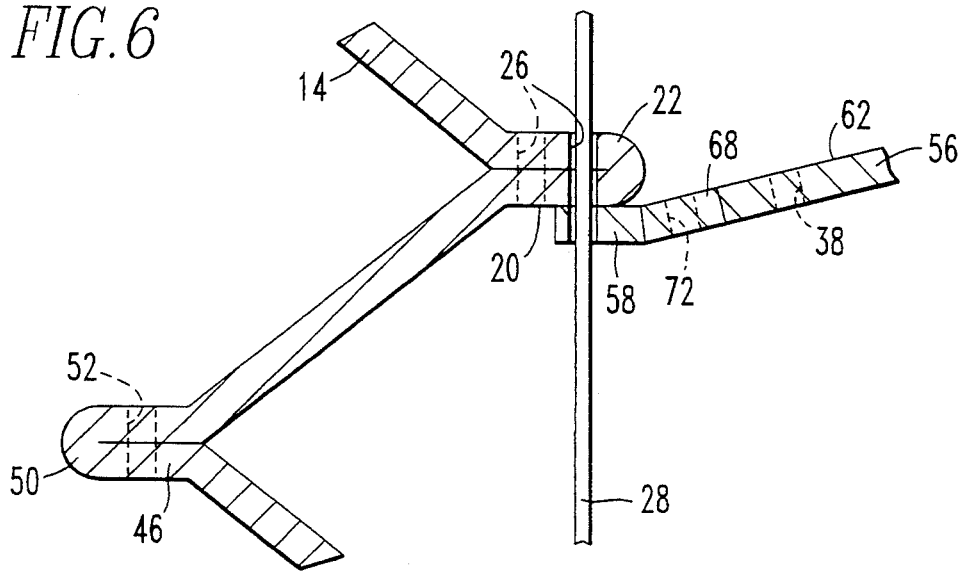
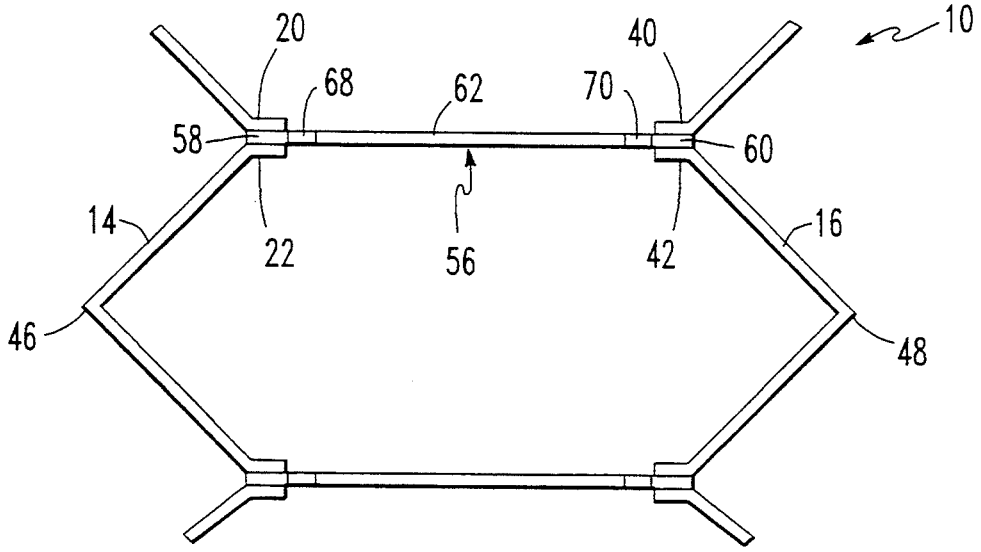
FIG. 7

FIG. 8
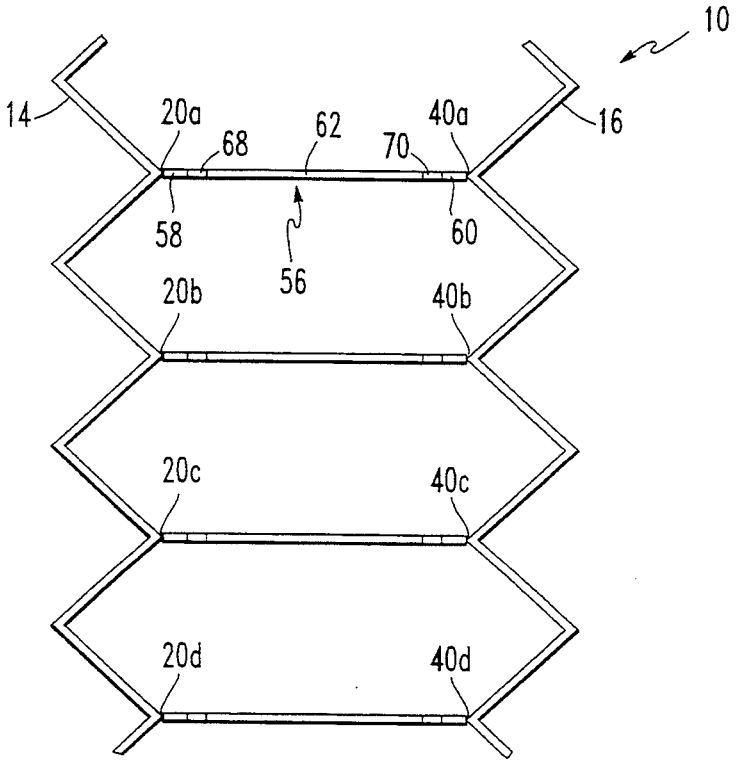
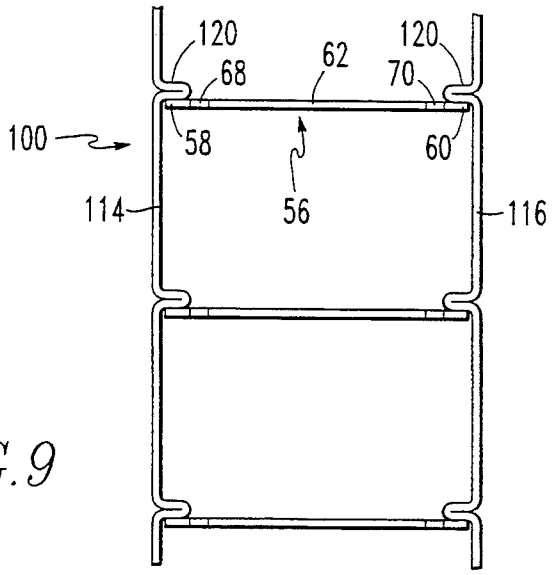
FIG. 9

FIG. 9A
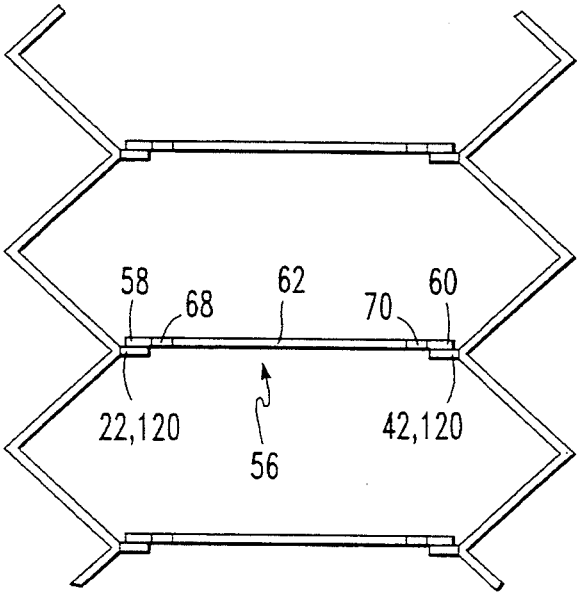
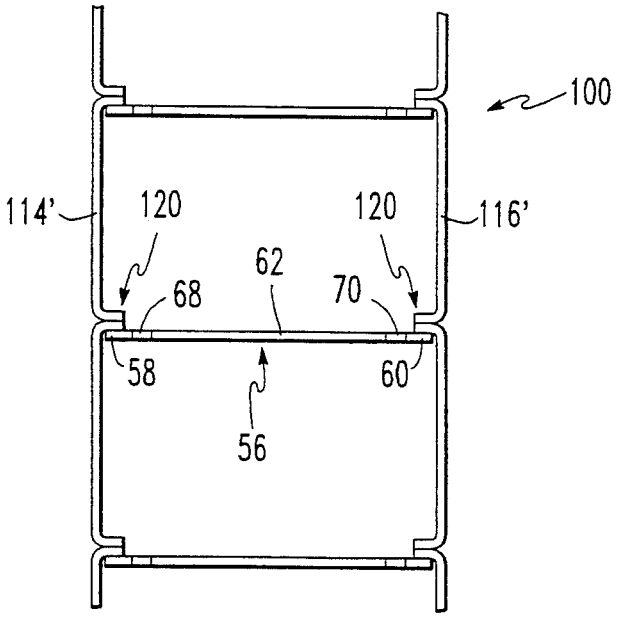
FIG. 10

VENETIAN-TYPE WINDOW COVERING

RELATED APPLICATIONS

This application is a continuation-in-part of application Ser. No. 624,312, filed Dec. 4, 1990, now U.S. Pat. No. 5,176,192, which is a continuation-in-part of application Ser. No. 340,301, filed Apr. 19, 1989, now U.S. Pat. No. 4,974,656, which is a continuation-in-part of Ser. No. 030,167, filed Mar. 25, 1987 now abandoned.

BACKGROUND OF THE INVENTION

1. Field of the Invention

This invention relates generally to the field of window coverings and more particularly to venetian-type window covering structures that provide selective privacy and selective thermal insulation.

2. Description of the Prior Art

The window shade industry has developed many methods and apparatus for covering windows that provide privacy and thermal insulation while being aesthetically pleasing. Such window coverings should be capable of being raised and lowered as access to the window and other factors dictate.

It would be advantageous to provide a venetian-type window covering that could, without being raised or lowered, be selectively placed in a closed position that provides privacy and insulation. The window covering should also be capable of being moved into an open position, allowing light and air to pass through the window covering.

One attempt to provide such a window covering is disclosed in U.S. Pat. No. Re. 30,254 to Rasmussen. Rasmussen shows a honeycomb curtain structure that operates as a venetian-type window cover. Rasmussen accomplished this by forming a curtain structure from a series of foldable cells adhered together. Each cell has opposed side portions and a connected part. Thus, when the cells are connected, one series of connected side portions form a front of the curtain structure and the opposite series of connected side portions form a back of the structure. The structure of Rasmussen also has a series of connecting parts being parallel to and spaced apart from one another located between the front and back of the curtain. In this configuration, the curtain may either be rolled-up on a roller or lifted with cords running between the front and back portions and through the connecting parts.

SUMMARY OF THE INVENTION

I provide a honeycomb window covering structure that operates as a venetian. The present window covering structure has two sheets of material. The sheets are spaced apart and are oriented so as to be generally parallel to one another. A series of slats connects the first and second sheets of material. Connecting each slat to the first and second sheet of material, respectively, are first and second connecting portions. The connecting portions may be tabs formed on pleats of the first and second material, tabs formed on the slats themselves, extending portions extending out to one side only of each sheet of material, a separate structure such as separate sections of material affixed to the sheets of material, or a flexible adhesive between the slats and the first and second material, or any combination thereof. The connecting portions provide a space between the moving portion of the slats and the sheets of material through which lift cords may be run.

A preferred embodiment of the window covering structure has a sheet of first material and a sheet of second material that are preferably pleated so as to have a plurality of transverse folds lying on the sheets. The folds are alternatingly directed in opposite directions to one another such that one side of the sheet of first material has a series of inward-directed pleats disposed thereon. The opposite side of the sheet of first material defines a front of the structure and has a series of outward-directed pleats disposed thereon. Similarly, one side of the sheet of second material has a series of inward-directed pleats disposed thereon. The other side of the sheet of second material defines a rear of the structure and has a series of outward-directed pleats disposed thereon. The sheets of material are preferably made of a continuous, single piece of fabric, but sections of material may be spliced together to form the sheets of material.

The first and second material sheets are spaced apart and oriented so that each inward pleat of second material is directed towards a corresponding inward pleat of first material. Each corresponding set of first material inward pleats and second material inward pleats are connected by a slat. Each slat has a first tab and a second tab. The first slat tab is affixed to the inward pleat of first material and a second slat tab is affixed to the inward pleat of second material. Each slat also has an intermediate portion lying between the first slat tab and the second slat tab, in which the intermediate portion is connected to the first slat tab by a first hinge and is connected to the second slat tab by a second hinge. The hinges may be separate elements or may be of the same material as the slats. The hinges are preferably formed when made of the same material as the slat by folding or bending the slats at the appropriate locations or alternately when a woven material is used for the slats some material may be removed at the hinge location. Any convenient means of facilitating the folding of the slat at the appropriate location may be used to create the hinge.

The slat intermediate portions each have opposed face surfaces. When the sheets of first and second materials are positioned relative to one another such that the structure is in an open position, the slats are spaced apart and are generally parallel to one another and generally perpendicular to the first and second material sheets. When the first and second material sheets are moved into a closed position, the slat intermediate portions are moved about the hinges such that the intermediate portions are spaced apart and are generally aligned with one another and the face surface of each slat is substantially parallel to the first and second material sheets. However, the slat tabs remain substantially perpendicular to the sheets of first and second material regardless of whether the structure is in the closed or open position. By remaining perpendicular to the first and second sheets of material, the slat tabs ensure that the structure has a honeycomb configuration in both the open and closed positions while providing a space for a selected number of cords to run through without interfering with the tilting of the structure through the open and closed positions and conversely providing a cord path that will not become restricted when the structure is moved through the open and closed positions.

The first sheet of material and the second sheet of material are both preferably made of a material that does not act as a barrier to heat or light such as an open-weave polyester. The slats are preferably made of a nontransparent material that is also preferably thermally insulating such as polypropylene film. In the open position, the slats are spaced apart and are parallel to one another and are sufficiently thin so that the thin edges of each slat facing to the front and rear of the structure do not substantially obstruct heat and light from passing therethrough. Thus, one operating the window covering structure when facing either the front of the structure or the rear of the structure would be able to see through the window covering structure when it is in the open position. However, when the structure is in a closed position the face surfaces of the slat intermediate portions become aligned and preferably overlap slightly facing the front and rear of the structure. Thus, a barrier is formed by the slats preventing heat and light from passing to and from the front and rear of the structure.

When it is desired to raise or lower the structure, the structure may be wound and unwound around a roller or may be raised and lowered by lift cords that are attached to the bottom of the structure.

In another preferred embodiment, the inward pleats have tabs formed at their ends. The first slat tabs is then affixed to the tabbed pleat of first material and the second slat tab is then affixed to the tabbed pleat of second material. The slat tabs are preferably affixed to the pleat tabs in an overlapped fashion. The overlapped pleat tabs and slat tabs thus form the connecting portions of this embodiment. Holes may be placed in the tabbed inward pleats so that one or more lift cords may each be disposed through a series of holes. Alternatively, holes for the lift cords may be placed in either or both of the hinges of each slat or in the slat tabs. In the instance when the structure is raised by lift cords, the structure is able to collapse upon itself yielding a tight stack.

Another preferred embodiment of the window covering structure is substantially identical to the preferred embodiments described above except that the folds or pleats of the first and second sheets of material are directed toward only one side of each sheet of material respectively. The pleats may have tabs formed on them as described above. Thus, the sheets of material of this embodiment have extensions that extend outward from one side only of each sheet. The alternative sheets of material for this embodiment may be formed by folding a continuous sheet, or by splicing several sections of material such that a portion of the spliced sections of material extend outward, or by affixing separate pieces of material to the first and second sheets of material. Therefore, the extensions from the sheets of material of this embodiment may be tabbed or untabbed pleats or affixed sections of material. Each corresponding set of extensions of the sheet of first material and the sheet of second material are connected by the hinged slat of the first embodiment. Also, a structure could be made that used one sheet of material having pleats directed towards both sides as described in the first embodiment and the other sheet of material may have pleats directed towards only one side of the sheet.

Another preferred embodiment is substantially identical to the above described embodiments except that straight, continuous sheets of first and second material are used. Therefore, no extensions from the sheets of material are present. The hinged slats of the first embodiment are abuttingly affixed to the first sheet of material and second sheet of material.

In any of the above-described embodiments, an alternative slat may be used. The alternative slat is a straight unhinged member. One end of the slat is affixed to the first material and an opposite end of the slat is affixed to the second material. The slats are affixed to the first and second material by a flexible adhesive that also acts as a hinge. The flexible adhesive connecting portions may have holes placed in them so that lift cords may be disposed therethrough.

Other objects and advantages of the invention will become apparent from a description of certain present preferred embodiments thereof shown in the drawings.

BRIEF DESCRIPTION OF THE DRAWINGS

FIG. 1 is a side elevation view of a portion of the first preferred window covering structure in the open position.

FIG. 2 is a side elevation view of a portion of the first preferred window covering structure in the closed position.

FIG. 4 is a perspective view of a portion of a shade showing a tab.

FIG. 4A is a perspective view of a portion of a second preferred embodiment of the window covering structure showing an alternative tab.

FIG. 5 is a side view of a portion of the first preferred window covering structure in a stacked position showing a Z-shaped configuration.

FIG. 5A is a side view of a portion of the first preferred window covering structure in a stacked position showing a flat configuration.

FIG. 6 is a cross sectional view of a portion of the first preferred window covering structure.

FIG. 7 is a side elevation view of a portion of a third embodiment of the window covering structure which has an alternative means of affixing the slats to the first and second material.

FIG. 8 is a side elevation view of a portion of a fourth preferred window covering structure having untabbed inward pleats.

FIG. 9 is a side elevation view of a portion of a fifth preferred embodiment of the window covering structure.

FIG. 9A is a side elevation view of a portion of an alternative preferred embodiment of the window covering structure.

FIG. 10 is a side elevation view of a portion of a sixth preferred embodiment of the window covering structure.

DETAILED DESCRIPTION OF THE PREFERRED EMBODIMENT

The present window covering structure has two sheets of material. The sheets are spaced apart and have a series of spaced apart slats connecting the first material with the second material. Connecting each slat to the first and second sheet of material, respectively, are first and second connecting portions. The connecting portions may be tabs formed on pleats of the first and second material, tabs formed on the slats themselves, extending portions that extend to one side of each sheet of material may be a separate structure such as separate sections of material affixed to the sheets of material, or a flexible adhesive between the slats and the first and second material, or any combination thereof. The connecting portions provide a space through which lift cords may be run and also allow the window covering structure to retain a honeycomb configuration in both the open and closed positions.

Figure 3:
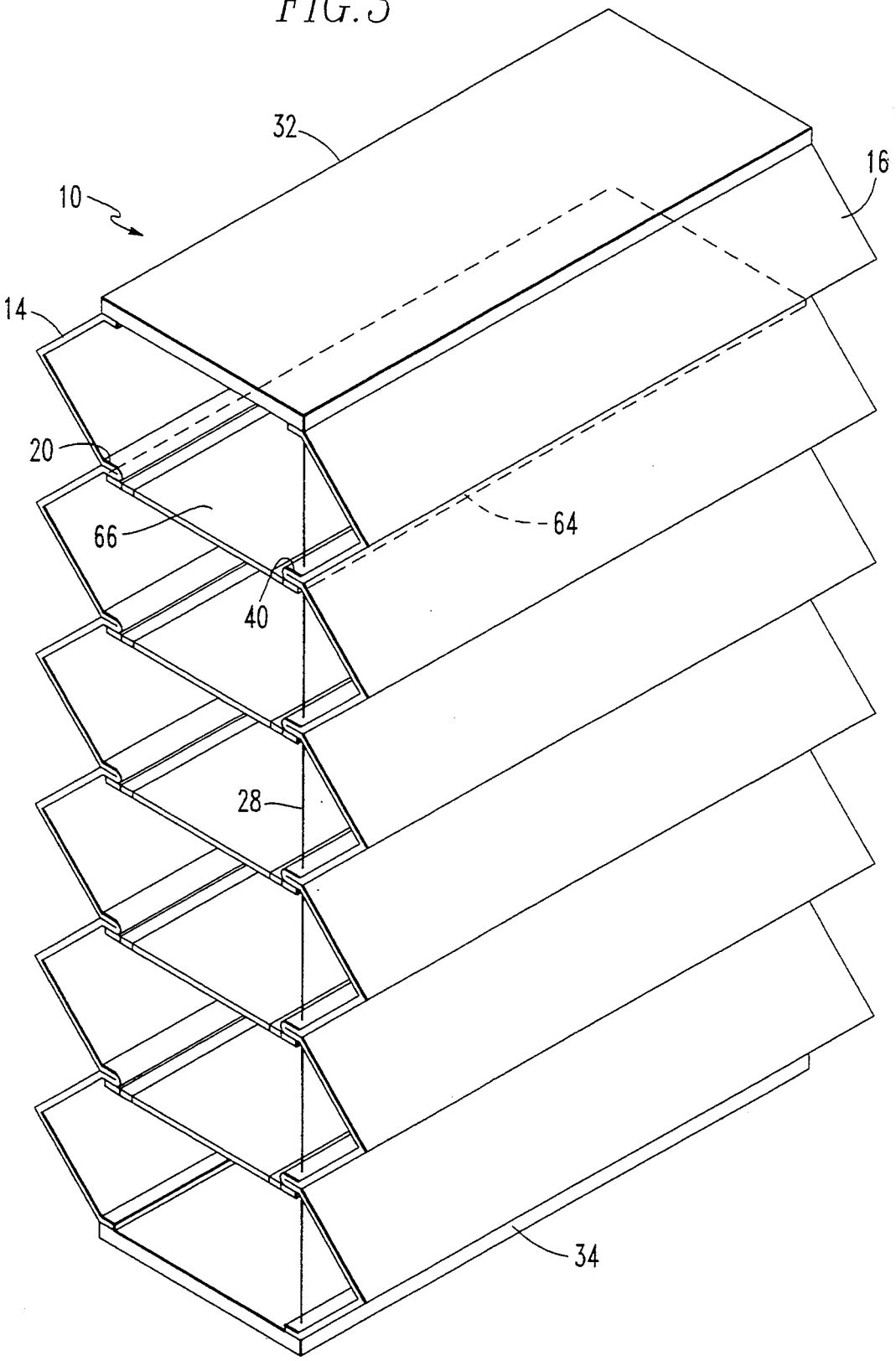
FIG. 3 is a perspective view of the first preferred window covering structure in an open position.

Referring first to FIGS. 1, 2 and 3, a first preferred embodiment of the honeycomb window covering structure 10 is shown. Structure 10 has a sheet of first material 14 and a sheet of second material 16. Preferably, first material 14 and second material 16 are pleated so as to have a plurality of transverse folds lying on the sheets. The folds are alternatingly directed in opposite directions to one another such that one side of the sheet of first material 14 has a series of inward-directed pleats 20*a* through 20*d*. The opposite side of the sheet of first material 14 defines a front 76 of the structure and has a series of outward-directed pleats 46. Similarly, one side of the sheet of second material 16 has a series of inward pleats 40*a* through 40*d*. The opposite side of the sheet of second material 16 defines a rear 78 of the structure and has a series of outward pleats 48. Preferably, inward pleats 20*a* through 20*d* have tabs 22 formed on them. Similarly, the inward pleats 40*a* through 40*d* preferably have tabs 42 formed on them. The first material 14 and the second material 16 are each preferably made of a transparent material that does not act as a barrier to heat or light. Additionally, the outward pleats 46 and 48 of both the first material 14 and the second material 16 may be formed with tabs 50 as shown in FIG. 6.

In the embodiment of FIG. 1, the first material 14 and second material 16 are spaced apart and are oriented relative to one another such that each tab 42 of second material is directed towards a corresponding tab 22 of first material. Each corresponding set of first material tab 22 and second material tab 42 are connected by a slat 56. Slat 56 has a first slat tab 58 that is affixed to the first material tab 22. Each slat 56 also has a second slat tab 60 that is affixed to the second material tab 42.

The slats are connected to the first and second materials 14 and 16 by any convenient means such as sewing, melting or through adhesives. When the slat portions 58 and 60 are affixed to tabs 22 and 42, the slat portions may be affixed to any portions of the tabs 22 and 42 and may thus overlap over the entire length of the tabs 22 and 42, extend over only a portion of the tabs 22 and 42 or may be abuttingly affixed to the tabs.

Each slat 56 further has an intermediate portion 62 lying between the first slat tab 58 and the second slat tab 60. The slat intermediate portion 62 is connected to the first slat tab 58 by a first hinge 68. Similarly, the slat intermediate portion 62 is connected to the second slat tab 60 by a second hinge 70. The hinges 68 and 70 may be constructed of separate pivotable elements or may preferably be made of the same material as the slats 56 formed in any convenient manner of facilitating bending of the material, such as by prefolding the slats 56 at the appropriate locations or removing some material from the weave of slats made of woven material.

Each slat 56 has opposed face surfaces 66 and longitudinal edges 64. Each slat 56 is sized and configured so that the edges 64 are very thin relative to the face surfaces 66. The slats 56 are preferably made of a thermally insulating, nontransparent material such as polypropylene film or tightly woven polyester.

Selected successive inward pleats of first material 14 have been designated as 20*a* through 20*d* to demonstrate the operation of the structure. Likewise, selected corresponding successive inward pleats of second material 16 have been designated as 40*a* through 40*d* to demonstrate the operation of the structure. Thus, first material inward pleat 20*a* is connected to pleat 40*a* by a slat, while inward pleat 20*b* is connected to second material inward pleat 40*b* by a slat and so on.

In accordance with the teachings of this invention, and as may be seen in FIG. 4, the two sections of first material 14 forming each of the inward pleats 20 are secured together along substantially the entire width of the shade and at a point a short distance from the pleat to form a plurality of tabs 22. The joint or seam 24 which results in the tabs 22 may be formed by welding, sewing, gluing or other suitable means. For a preferred embodiment of the invention, the joint is formed by ultrasonic welding. The length of the tabs 22 will vary with application.

The memory, strength and rigidity of pleats may be significantly enhanced by providing a multiple bond or a continuous bond between the fabric layers forming each tab. Thus, a single or multiple bond joint may be provided. Alternatively, the two sections of material may be adhered together over substantially the entire area, or the tabs may be separate elements affixed to the sheets of material.

In a second preferred embodiment, shown in FIG. 4A, a bond joint 24*a*, in this case a double weld joint such as that shown in FIG. 4, is being utilized to splice together two pieces of first material 14 and 14′ rather than to merely secure together two sections of the same piece of material. Thus, the first and second materials 14 and 16 may be a continuous sheet of fabric or may be a sheet of fabric formed by the splicing of separate pieces of fabric. The joint 24*a* still results in the formation of a tab 22 that may have cord holes 26 formed therein through which a cord 28 may pass. The pieces of material may be spliced together by any convenient means. In a third preferred embodiment of the window covering structure, the slats may be affixed to the spliced tabs by being disposed between the two pieces of material and being bonded therewithin as shown in FIG. 7.

The formation of tabs has been to this point discussed in terms of the inward pleats of first material. However, it is understood that the second material may also have tabs 42 formed in the above described manner on the inward pleats. Furthermore, it is also understood that the above described formation of tabs is also applicable to the formation of tabs 50 on the outward pleats of first and second material 14 and 16 as shown in FIG. 6.

This window covering operates much like a venetian blind. By manipulating the position of the first material 14 and second material 16 relative to one another, the window covering structure 10 may be placed in an open position as shown in FIG. 1 or closed position as shown in FIG. 2. The open position is formed when the inward pleats of first material are directed towards the corresponding inward pleats of second material. Thus, in the open position, inward pleat 20*a* is directed towards inward pleat 40*a*, inward pleat 20*b* is directed toward inward pleat 40b and so on. With the corresponding inward pleats being directed toward one another, the slat intermediate portions 62 are caused to be spaced apart and generally parallel to one another. Thus, in the open position, the thin edges 64 of each slat 56 are directed towards the front 76 and rear 78 of the structure 10. The edges 64 are sufficiently thin so that they do not substantially obstruct heat and light from passing between the front 76 and rear 78 of the structure 10.

Referring next to FIG. 2, the structure 10 may be moved into a closed position. Once, in the closed position, the intermediate portion 62 of each slat 56 become coplanar and preferably overlap slightly. In this aligned position, the slat face surfaces 66 are generally parallel with the front 76 and rear 78 of the structure 10. Thus, a barrier is formed by the slats 56 when the structure 10 is in the closed position, preventing heat and light from passing to and from the front 76 and rear 78 of the structure 10.

As can be seen by comparing FIGS. 1 and 2, the slats 56 are able to move about hinges 68 and 70. As slats 56 are moved about hinges 68 and 70, the relative position of the first material 14 to the second material 16 is shifted. In this manner, the structure 10 may be placed selectively into either the open or the closed position by adjusting the position of the first material 14 and second material 16 relative to one another. The amount of shifting of the first material 14 and second material 16 relative to one another necessary to effectuate a change between the open and closed positions is dependent upon the length of the slat intermediate portions 62. The hinges 68 and 70 enable the intermediate portion 62 of each slat to pivot relative to the slat first and second tabs 58 and 60, allowing the intermediate portions 62 to be moved from parallel and spaced apart from one another as shown in FIG. 1 to being generally coplanar and overlapped as shown in FIG. 2. However, the hinges 68 and 70 of each slat allow the slat first and second tabs 58 and 60 and the pleat tabs 22 and 42 to which they are affixed to remain generally perpendicular to the first and second sheets of material 14 and 16 whether the structure is in the open or closed position. The connecting portions for this embodiment are the overlapped pleat tabs and slat tabs. By remaining perpendicular to the first and second sheets of material 14 and 16, the connecting portions ensure that the structure has a honeycomb configuration in both the open and closed positions. The connecting portion tabs also provide a structure through which lift cords may be disposed that does not substantially tilt and therefore does not inhibit the travel of the lift cord through the cord hole.

The preferred amount of shift of the first and second materials relative to one another is the space between two adjacent pleats on a sheet of material plus the overlap. Thus, whether in the open position or closed position, the structure has a generally honeycomb configuration, as can be seen in FIGS. 1 and 2. The preferred shift of the relative position between the first and second materials 14 and 16 when the structure is in the closed position can be seen in FIG. 2. In the closed position, inward pleat 20a is now directed toward inward pleat 40b, inward pleat 20b is now directed toward inward pleat 40c and so on. Thus, the first and second materials 14 and 16 have been shifted by one pleat plus the overlap.

For the structure 10 to be in either the open or closed position, the structure 10 must be extended as is shown in FIGS. 1 and 2. However, it is often desirable to have the structure 10 moved sufficiently out of the way of the window it is covering. In this instance, the structure 10 may be stacked as shown in FIGS. 5 and 5A. When the structure 10 is placed in the stacked position, outward pleats 46 and 48 are flattened and are placed in close proximity to one another. Similarly when the structure 10 is in the stacked position, the inward pleats of the first and second material are flattened and placed in close proximity to one another. When this flattening of the structure 10 occurs, slats 56 are necessarily brought within close proximity to one another. The preferred stacking of the structure 10 results in a Z configuration as shown in FIG. 5. The Z configuration enhances closure when tilted. The stacking of the structure 10 may also selectively result in a flat configuration as shown in FIG. 5A.

Referring next to FIG. 6, a portion of the structure 10 is shown. Although FIG. 6 shows only a portion of the first sheet of material 14 and slat 56, the second sheet of material 16 is a mirror image to which the description is equally applicable. The structure 10 has at least one lift cord 28 preferably provided through it so as to actuate the raising and lowering of the structure. The lift cord 28 is placed through holes 26 extending through the structure 10. The cord holes 26 may be placed on the inward pleats 20 and 40 or on the tabbed ends of the pleats. As can be seen in the figure, the first and second slat tabs 58 and 60 may be affixed to only a portion of tabs 22 and 42 so as to leave an area on tabs 22 and 42 that is not affixed to the first and second slat tabs 58 and 60. The cord holes 26 may be situated in this area thereby allowing the lift cord 28 to pass through a hole placed only in tabs 22 and 42 and not through the first and second slat tabs 58 and 60 as well. Alternatively, the cord holes 26 may be placed through both tabs 22 and 42 and the first and second slat tabs 58 and 60. Additionally, the first and second slat tabs 58 and 60 may be affixed to the entire width of tabs 22 and 42 in which case a cord hole 26 placed through tabs 22 and 42 would extend through the first and second slat tabs 58 and 60 as well. The cord holes 26 may also be placed in the hinges, in which case it is preferred to have hinges 68 and 70 that are extended so as to allow a cord to readily pass through without restriction. Similarly, when the inward pleats of first and second material are not tabbed, the cord holes 26 may be placed through the inward pleats alone or through both the first and second slat tabs 58 and 60, or through the hinges 68 and 70.

The lift cords 28 may alternatively be disposed through holes in either of or both of the hinges 68 and 70 of each slat 56. The hinge holes 72, shown in dotted line in FIG. 6, allow the lift cord 28 to be disposed through the slat and not the first or second material 14 and 16, while not placing a perforation on the face surfaces of the slats, thereby keeping privacy and insulation intact when the structure 10 is in the closed position.

Furthermore, holes for the lift cords may be placed in either of or both sets of outward pleats 46 and 48 or in the tabbed ends 50 of the outward pleats. The outward pleat holes 52 are shown in dotted line in FIG. 6. The outward pleat holes 52 also allow placement of the lift cords without affecting the privacy or insulation of the face surface barrier of the structure in the closed position.

Although the holes for the lift cords 28 may also be placed on the slat face surface 66, this is not preferred as the holes 38 will allow the passage of heat and light when the structure 10 is in the closed position. This barrier to heat and light is left intact when the holes are placed on the inward pleats, outward pleats or hinges.

To assist in the raising and lowering of the structure 10, the structure may be mounted within a headrail 32 and a bottomrail 34 as shown in FIG. 3. Thus, an upper portion of the first and second materials 14 and 16 are affixed to the headrail 32. And the lower portion of the first and second materials 14 and 16 are affixed to the bottomrail 34.

In positioning the structure 10 into the closed or open position, it is unimportant whether the first material 14 is moved, the second material 16 is moved, or whether both the first and second materials 14 and 16 are moved. The opening and closing operation may be performed by any convenient means that would change the relative positions of the first and second materials 14 and 16 such as tilting the headrail, tilting any bottomrails or by placing separate lift cords through at least one of the first and second materials 14 and 16.

The first and second materials 14 and 16 are preferably formed of a perforated material. By maximizing the number and the area of the perforations, the material becomes virtually transparent and provides essentially no barrier to heat or light. The preferred first and second materials 14 and 16 are made of an open weave polyester. The first and second materials 14 and 16 may be made of the same material or may be made of different material. The weave patterns chosen for the first and second materials 14 and 16 should be ones that do not cause interference in vision when one views through both patterns. Preferably, whichever of the first and second materials that faces the interior of a room is colored for aesthetic appeal. The opposite material which faces toward the outside of the window is preferably white. The slats, which are preferably formed of a nonperforated material, are preferably white, on the side facing outside of the window, while the side facing the interior of the room is preferably colored a color that is complimentary to the color selected for the first or second material.

Although it is preferred that the inward pleats of the first sheet of material 14 and second sheet of material 16 have tabs formed upon them, the pleats may be untabbed as shown in the fourth preferred embodiment of FIG. 8. The slats 56 would be connected directly to the untabbed inward pleats. Thus, the slat first portion 58 and slat second portion 60 are abuttingly affixed to inward pleats 20*a* through 20*d* and 40*a* through 40*d*, respectively. In all other respects and in operation, the untabbed embodiment of the window covering structure is identical to the tabbed embodiments.

A fifth embodiment of the window covering structure 100 shown in FIG. 9, is substantially identical to the first preferred embodiment described above except that alternative first and second sheets of material 114 and 116 are used that have extensions 120 which may be folds in the continuous sheet of material that extend outward from one side only of each sheet. The extensions 120 overlappingly affixed to the slat tabs 58 and 60 are the connecting portions of this embodiment. The first sheet of material 114 and second sheet of material 116 are oriented relative to one another such that each extension 120 of first material 114 is directed toward a corresponding extension 120 of second material 116. Each corresponding set of extensions 120 of first material and second material are connected by the slat 56.

In a sixth preferred embodiment, the extensions 120 may be alternatively formed by splicing together pieces of material 114' and 116' as shown in FIG. 10. Alternatively, separate segments of material may be the extensions by being adhered to a sheet of material as shown in FIG. 9A. Also, one sheet of material may have pleats directed in opposite directions and the other may have either no pleats or pleats directed in only one direction. Holes for lift cords to pass therethrough may be placed in any combination of the first and second slat tabs and the extensions. The operation of this embodiment is substantially identical to the operation of the first preferred embodiment, except that when the structure is placed in a stacked position, the first and second sheets of material do not collapse about preformed creases but rather fold about soft creases that form naturally upon the collapsing material.

Figure 11:
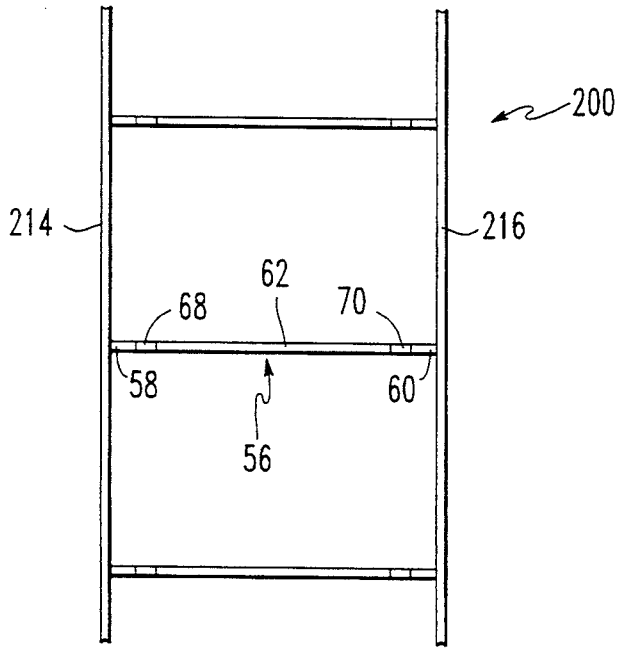
FIG. 11 is a side elevation view of a portion of a seventh preferred window covering structure.

The window covering structure 200, shown in FIG. 11, is substantially identical to the first and second preferred embodiments except that straight, unpleated sheets of first and second material 214 and 216 and having no extensions are used. The hinged slats 56 are abuttingly affixed at each end of the slat to the first sheet of material 214 and second sheet of material 216. The operation of this embodiment is substantially identical to the operation of the preferred embodiment except that when the structure is placed in a closed position, the first and second sheets of material collapse and fold about soft creases formed naturally in the material upon collapsing of the material.

Figure 12:
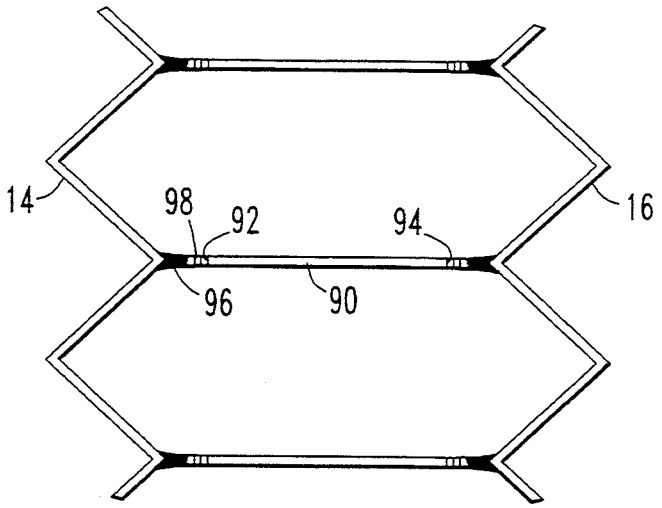
FIG. 12 is a side elevation view showing an alternative slat used in a portion of an eighth preferred embodiment of the window covering structure.

In any of the above-described preferred shade embodiments, an alternative slat 90, shown in FIG. 12, may be used. The alternative slat 90 is a relatively thin, flat, unhinged member. A first end 92 of the slat 90 is affixed to one side of the sheet of first material and a second end 94 of the slat 90 is affixed to the opposite side of the sheet of second material. The connecting portions that flexibly affix slats 90 to the first and second sheets of material are a flexible adhesive 96. The flexible adhesive 96 allows the slats 90 to move relative to the first and second sheets of material into a closed and open position in the identical manner as described in the preferred embodiments. Therefore, flexible adhesive 96 also acts as hinges. The region in which the flexible adhesive 96 is placed is preferably wide enough such that at least one lift cord 28 may be disposed through corresponding holes 98 placed through the flexible adhesive 96. The preferred flexible adhesive 96 is a plurality of strands of adhesive. The adhesive 96 may be applied through a heated reservoir so that the adhesive 96 is applied in a liquid state. The liquid adhesive 96 will adhere to a surface it contacts, thus the strand of adhesive 96 is placed upon and travels back and forth between the end of the slat 56 and the sheet of material, adhering to each. As a result, a plurality of strands of flexible adhesive connect the slat to the sheet of material much like a spider web. Any suitable material may be used as the flexible adhesive such as polyester.

Figure 13:
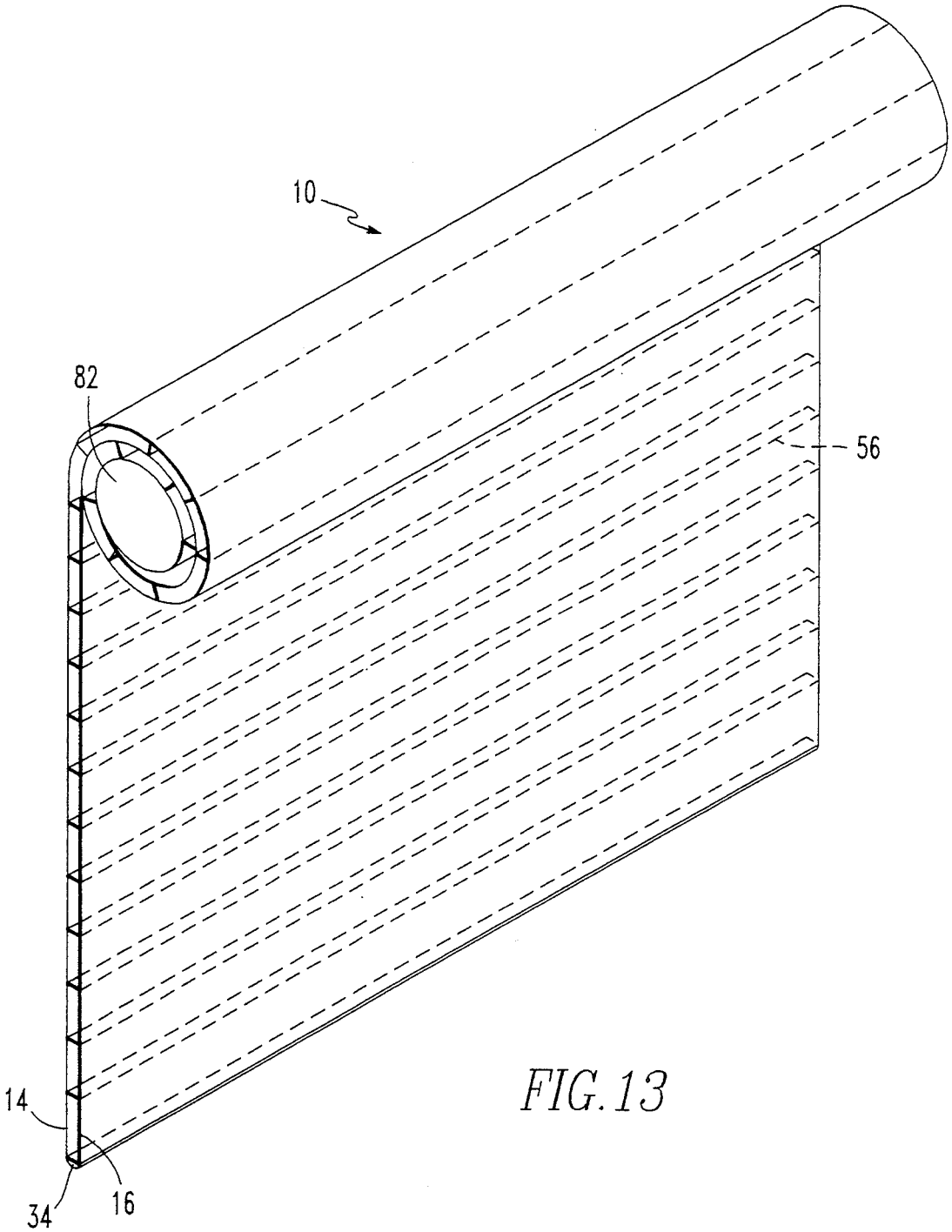
FIG. 13 is a perspective view of a ninth preferred embodiment having a roller for raising and lowering the preferred window covering structure.
Figure 14:
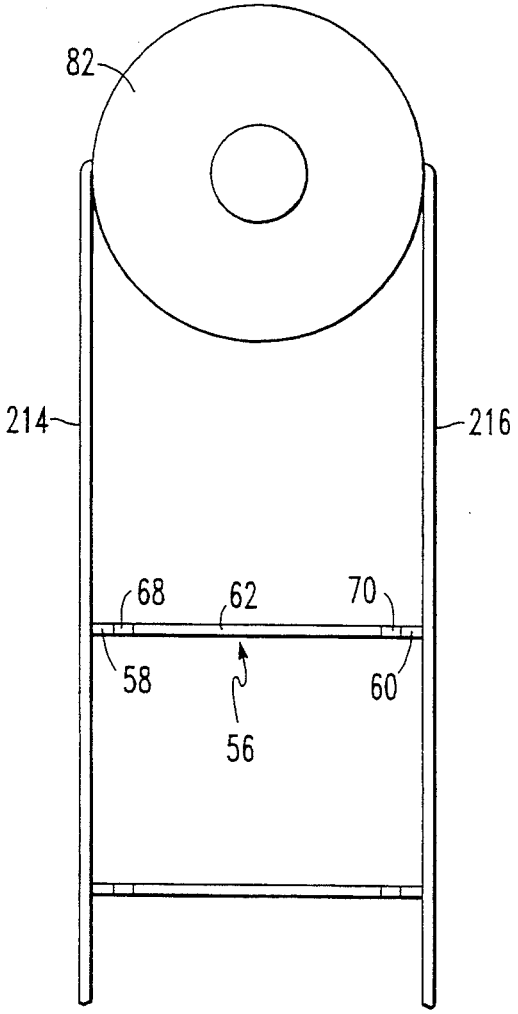
FIG. 14 is a side elevation view of a portion of the ninth preferred embodiment in an open position.
Figure 15:
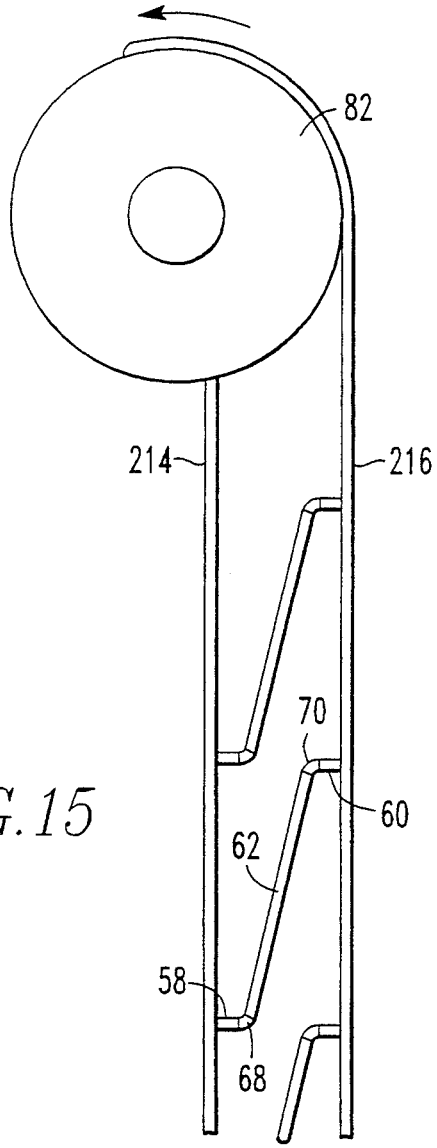
FIG. 15 is a side elevation view of a portion of the ninth preferred embodiment in a closed position.

Variations of the preferred embodiments could be made. Any number of lift cords 28 may be employed to raise and lower the window covering structure. Furthermore, the window covering structures described above may be raised and lowered by other convenient means such as by winding or unwinding the structure about a roller 82, seen in FIG. 13. In addition to raising and lowering the window covering structure with roller 82, the roller 82 may also be used to open and close the structure. If the upper ends of the first material and second material are circumferentially affixed to the roller at a distance, then the roller may be oriented, as shown in FIG. 14, in the open position. However, if the roller 82 is then partially turned, as shown in FIG. 15, the relative positions of the first material and second material are shifted and the structure is moved in the closed position.

Although the figures for the tabbed embodiments show the slats being connected to the pleat tabs along the bottom of each pleat tab, the slats could be connected along the top of each pleat tab. Additionally, the slats could be connected to the bottom of the pleat tabs of the first material and to the top of the pleat tabs of the second material, or along the top of pleat tabs of the first material and to the bottom of the pleat tabs of the second material. In the latter two cases, if the pleat tabs were sufficiently rigid relative to the slats, the tabs could act as a fulcrum causing the slat to bend around the tabs when moved into the closed position.

While certain present preferred embodiments have been shown and described, it is distinctly understood that the invention is not limited thereto but may be otherwise embodied within the scope of the following claims.

I claim:

1. A window covering structure comprising:

an elongated sheet of first pleated material having a selected length and having a plurality of transverse pleats, the pleats being alternatingly directed in opposite directions to one another so as to have a series of inward pleats disposed on one side of the first sheet of material and having a series of outward pleats disposed on an opposite side thereof;

an elongated sheet of second pleated material having a selected length and having a plurality of transverse pleats, the pleats being alternatingly directed in opposite directions to one another so as to have a series of inward pleats disposed on one side of the second sheet of material facing the inward pleats of the first sheet of material and having a series of outward pleats disposed on an opposite side of the second sheet of material;

a plurality of elongated slats, each slat having opposite face surfaces, a first end and a second end, each slat being positioned between the sheet of first material and the sheet of second material;

a plurality of first and second connecting portions to which the first sheet and the second sheet are respectively attached, each first connecting portion being connected to the first end of each slat, and each second connecting portion being connected to the second end of each slat; and a plurality of first and second hinges, each pair of first and second hinges pivotably connecting each slat to the first and second connecting portions, respectively, each first hinge being disposed between each first connecting portion and each slat, and each second hinge being disposed between each second connecting portion and each slat;

wherein when the sheet of first material and the sheet of second material are positioned relative to one another such that when the structure is in an open position, the slats are spaced apart and the face surfaces of each slat are substantially parallel to one another and substantially perpendicular to the length of the first material and the second material, and when the structure is moved to a closed position, the slats move so as to have the face surfaces of each slat being generally aligned with one another on a common plane that is substantially parallel to the length of the first material and the second material and the connecting portions are substantially perpendicular to the place of the slats, and wherein the structure retains a cellular configuration in both the open and closed positions.

2. The window covering structure of claim 1 wherein each pair of connecting portions have at least one hole for a lift cord to be disposed therethrough.

3. The window covering of claim 1 wherein the first and second connecting portions are made of the same material as the slats.

4. The window covering structure of claim 1 wherein each inward pleat of at least one of the first material and the second material are tabbed.

5. The window covering structure of claim 4 wherein the first connecting portion is comprised of the first end of the slat being overlappingly affixed to the tabbed pleat of the first sheet of material, and the second connecting portion is comprised of the second end of the slat being overlappingly affixed to the tabbed pleat of the second sheet of material.

6. The window covering structure of claim 1 wherein each outward pleat of at least one of the first material and the second material are tabbed.

7. The window covering structure of claim 4 wherein at least one of the sheets of first material and second material are formed of spliced sections of material and wherein the slats are affixed to the first and second sheets of material by being disposed within the spliced sections of material.

8. The window covering structure of claim 1 wherein at least one of the sheet of first material and the sheet of second material have a plurality of transverse pleats, the pleats of each sheet being directed in the same direction.

9. The window covering structure of claim 1 wherein the sheets of first material and the sheets of second material are spliced sections of fabric.

10. The window covering structure of claim 1 further comprising a roller for raising and lowering the structure.

11. The window covering structure of claim 1 wherein the first material and the second material are transparent and the slats are made of a nontransparent material.

* * * * *